US005571336A

United States Patent [19]

Wurzburger et al.

[11] Patent Number: 5,571,336

[45] Date of Patent: Nov. 5, 1996

[54] BASE SOLUTION FOR CLEANING ALUMINUM

[76] Inventors: Stephen R. Wurzburger, P.O. Box C, Goodyear Bar, Calif. 95944; James M. Overton, 1127 Nickel La., Yuba City, Calif. 95991

[21] Appl. No.: 536,083

[22] Filed: Sep. 29, 1995

[51] Int. Cl.[6] ..... C23G 1/02

[52] U.S. Cl. ..... 134/2; 134/3; 134/10; 134/26; 134/27; 134/28; 134/29; 134/41; 252/79.2; 510/108; 510/254; 510/272

[58] Field of Search ..... 134/2, 3, 10, 26–29, 134/41; 252/79.2, 156, 174.25

[56] References Cited

U.S. PATENT DOCUMENTS

| | | | |
|---|---|---|---|
| 2,705,500 | 4/1955 | Deer | 134/3 |
| 3,048,547 | 8/1962 | Vosbigian et al. | 134/2 |
| 3,425,947 | 2/1969 | Rausch et al. | 134/2 |
| 3,870,560 | 3/1975 | Shumaker | 134/2 |
| 3,873,362 | 3/1975 | Mihram et al. | 134/3 |
| 4,116,853 | 9/1978 | Binns | 134/3 |
| 4,432,846 | 2/1984 | Honeycutt | 204/207 |
| 4,540,444 | 9/1985 | Kelly | 134/3 |
| 5,052,421 | 10/1991 | McMillen | 134/2 |
| 5,232,514 | 8/1993 | Van Sciver et al. | 134/26 |
| 5,279,755 | 1/1994 | Choy et al. | 252/76 |
| 5,346,641 | 9/1994 | Argo | 252/163 |
| 5,380,468 | 1/1995 | Gober et al. | 252/547 |

*Primary Examiner*—Jill Warden
*Assistant Examiner*—Sharidan Carrillo
*Attorney, Agent, or Firm*—Robert Samuel Smith

[57] ABSTRACT

A solution and solution concentrate for cleaning metal surfaces, particularly aluminum surfaces in which CaO or Ca $(OH)_2$ is added to sulfuric acid to raise the pH to about 13.1 after which the solution is passed through an eleven micron filter and potassium hydroxide is added to raise the pH to greater than 13.8. The resulting concentrate is diluted with water to an appropriate degree, generally 15 parts concentrate to 85 parts of water such as to bring the pH down to a working range of 8.5 to 11.0, degree of dilution depending on the usage.

8 Claims, 1 Drawing Sheet

1. Add sulfuric acid to water
2. Bring pH to 13.1 with Ca (OH)2
3. Filter solution
4. Bring pH to above 13.8 with KOH
5. Dilute with water
6. Apply to surface and rinse

FIG. 1

1. Add sulfuric acid to water
2. Bring pH to 13.1 with $Ca(OH)_2$
3. Filter solution
4. Bring pH to above 13.8 with KOH
5. Dilute with water
6. Apply to surface and rinse

BASE SOLUTION FOR CLEANING ALUMINUM

FIELD OF THE INVENTION

This invention relates to solutions for cleaning metals and particularly to an aqueous solution containing a high concentration of hydroxide ions for cleaning aluminum.

BACKGROUND OF THE INVENTION

The job of cleaning aluminum (such as cleaning airplanes) offers problems that are not associated with cleaning other metals. This is because, on the one hand, aluminum is a very reactive metal so that the unprotected metal is subject to severe reactions with cleaning agents and on the other hand, aluminum oxide forming on the surface of the aluminum is typically very hard and tenacious. The result is that when cleaning agents such as those containing sodium and potssium are used, severe etching can occur in places where the cleaning agent has penetrated the oxide layer.

Much effort has been devoted to developing effective methods for cleaning aluminum and these efforts have been generally directed toward the use of aqueous solutions that contain agents that react with exposed aluminum metal to form a coating that prevents corrosion (etching) discoloration and/or loss of adhesion of paint applied subsequent to the cleaning process. Other efforts have been directed toward the use of stabilizing agents that hold benign abrasive particulates in suspension for use as scouring media.

U.S. Pat. No. 4,432,846 to Honeycutt discloses a treatment for aluminum capacitor foil including an acid etch followed by immersion in a passivating carboxyl dip.

U.S. Pat. No. 5,32,5 14 to Sciver et al discloses a corrosion inhibiting cleaning system for aluminum surfaces including blasting the surface with a solution containing alkali metal bicarbonate particulates and a silicate.

U.S. Pat. No. 5,279,755 to Choy et al discloses a thickening aqueous abrasive cleaner with improved colloidal stability. The solution contains fine aluminum oxide particulates that are held in colloidal suspension by appropriate additions of a fatty acid derivative to provide an abrasive cleaner for an aluminum surface.

U.S. Pat. No. 5,346,641 to Argo et al discloses a thickened aqueous scouring cleanser containing an abrasive particulate, bleach and a multivalent buffering agent to confer an effective viscosity. Preferred abrasives include aluminum oxide and calcium carbonate. A preferred bleach is sodium hypochlorite. Preferred buffering agents are divalent phosphates or silicates.

U.S. Pat. No. 5,380,468 to Gober et al discloses an alkaline cleaning solution containing a surfactant, metal base and complexing agent. The preferred surfactant is quaternary ammonium cationic surfactant. The preferred base may be alkali or alkali earth borates, carbonates, hydroxides, silicates.

One of the problems with the solutions and cleaning systems disclosed in the foregoing paragraphs is disposal of the "environmentaly unfriendly" waste solutions containing surfactants, bleaches, etc. that issue from the cleaning operations. Another problem is the necessity to control the compositions of the respective solutions within a concentraion range that is effective for their intended purpose yet do not result in contaminating the surfaces that they are intended to clean.

SUMMARY

In view of the problem associated with the cleaning of an aluminum surface, it is therefore an object of this invention to provide an aqueous solution and a method for making the solution that is effective for use in cleaning an aluminum surface The invention is directed toward preparation of an aqueous solution involving the addition of CaO or $Ca(OH)_2$ to sulfuric acid sufficient to cause the precipitation of calcium sulfate and ultimately raise the pH of the solution to a pH of not greater than 13.1. The resulting solution is then passed through an eleven micron filter so as to remove any particles of calcium sulfate that are larger than eleven microns. Sufficient potassium hydroxide is then added to the solution to stabilize the solution.

BRIEF DESCRIPTION OF THE FIGURE

FIG. 1 is a flow chart of the method of the invention.

DESCRIPTION OF A PREFERRED EMBODIMENT

Turning now to a discussion of the drawing, FIG. 1 shows a flow chart of the steps in one embodiment for preparing the cleaning solution of this invention.

In step 1, 40 milliliters of concentrated (Bauml 12°) sulfuric acid is added to one liter of water.

In step 2, $Ca(OH)_2$ is added to carefully bring the pH of the solution up to a range of 12.8 to 13.1.

In step 3, the solution is passed through an eleven micron filter thereby removing any particulates of Ca $SO_4$ larger than eleven microns.

In step 4, sufficient potassium hydroxide is added to bring the pH up to a range of 13.8 to 14 thereby producing a basic solution In applying the solution to washing an aluminum surface such as the surface of an airplane, the following steps are followed:

In step 5, the resulting solution is added to water in the amount of 10 to 20% (attaining a pH of 8.5 to 11.0) but 15% is preferred thereby producing a cleaning solution.

In step 6, the cleaning solution is applied to the aluminmum surface and left on the surface for not more than a period of time depending on the condition of the aluminum surface. For example, in its application to cleaning the aluminum surface of an airplane, the time is generally between 30 and 60 seconds. Then the surface is washed off with water. Normal practice in cleaning an airplane surface is to swab about four square feet of surface with the cleaning solution of this inventon and then wash off the surface and procede to an adjacent area.

It will be understood that the ratio of the basic solution added to water will depend on the circumstances of the application. As mentioned above, the preferred concentration for cleaning airplane surfaces is 15% (pH is in the range of 8.5 to 11.0).

This invention offers a number of important features. One advantage is that the constituents of any rinse water are environmentally acceptable. Another advantage is that the cleaning solution leaves no film on the aluminum surface. Another advantage of the cleaning solution is that it has superior rheological properties that are stable over a long shelf life.

Variations of this invention may occur to the reader after reading a description of the embodiments presented in the the specification that are within the scope of the invention. For example, in some situations, sodium hydroxide may used in place of potassium hydroxide to stabilize the solution although potassium hydroxide is preferred particularly in situations where protection of the ecology is an important concern. CaO may be used in place of $Ca(OH)_2$. The solution concentrate has a wide range of applications where a stable heavy concentration of hydroxyl ions are required particularly to solutions used in the cleaning of aluminum surfaces.

We therefore wish to define the scope of our invention by the scope of the appended claims.

What is claimed is:

1. A method for preparing a solution concentrate to be used to clean a metal surface, said method comprising:

a) adding a concentrate of sulfuric acid to water to produce a sulfuric acid solution having a concentration of 10% to 20% acid in water by volume;

b) adding calcium oxide or calcium hydroxide to said sulfuric acid solution in a predetermined amount to form a calcium sulfate solution and to raise the pH of said calcium sulfate solution to a value in the range of 12.8 to 13.1;

c) passing the calcium sulfate solution through a filter to remove calcium sulfate particles; and d) producing a solution concentrate comprising adding an alkali hydroxide to said calcium sulfate solution in a predetermined amount to raise the pH to a value between 13.8 to 14.

2. The method of claim 1 wherein said filter is an eleven micron filter.

3. The method of claim 1, further comprising:

(e) producing a cleaning solution comprising mixing said solution concentrate with water in an amount of about 15 parts solution concentrate to 85 parts of water by volume.

4. The method of claim 1 wherein said alkali is potassium.

5. A method for cleaning an aluminum surface, said method comprising in sequential order:

a) adding a concentrate of sulfuric acid to water to produce a sulfuric acid solution having a concentration of 10% to 20% acid in water by volume;

b) adding calcium oxide or calcium hydroxide to said sulfuric acid solution in a predetermined amount to form a calcium sulfate solution and to raise the pH of said calcium sulfate solution to a value in the range of 12.8 to 13.1;

c) passing the calcium sulfate solution through a filter to remove calcium sulfate particles;

d) producing a solution concentrate comprising adding an alkali hydroxide to said calcium sulfate solution in a predetermined amount to raise the pH to a value between 13.8 to 14;

e) producing a cleaning solution comprising mixing said solution concentrate with water in an amount of about 15 parts solution concentrate to 85 parts of water by volume;

f) applying said cleaning solution to said aluminum surface;

g) allowing said cleaning solution to remain in contact with said aluminum surface for a predetermined period of time; and h) rinsing said cleaning solution from said aluminum surface.

6. The method of claim 5 wherein said filter is an eleven micron filter.

7. The method of claim 5 wherein said predetermined period of time is between 30 and 60 seconds.

8. The method of claim 5 wherein said alkali hydroxide is potassium hydroxide.

* * * * *